US006226982B1

(12) United States Patent
Poggio et al.

(10) Patent No.: US 6,226,982 B1
(45) Date of Patent: May 8, 2001

(54) METHOD FOR CONTROLLING THE STRENGTH OF THE AIR/FUEL MIXTURE SUPPLIED TO AN INTERNAL-COMBUSTION ENGINE

(75) Inventors: Luca Poggio, Spinetta Marengo; Marco Secco, Nizza Monferrato; Daniele Ceccarini, Rimini, all of (IT)

(73) Assignee: Magneti Marelli, S.p.A., Milan (IT)

( * ) Notice: Subject to any disclaimer, the term of this patent is extended or adjusted under 35 U.S.C. 154(b) by 0 days.

(21) Appl. No.: 09/378,760

(22) Filed: Aug. 23, 1999

(30) Foreign Application Priority Data

Aug. 25, 1998 (IT) ..... BO98A0503

(51) Int. Cl.[7] ..... F01N 3/00

(52) U.S. Cl. ..... 60/276; 60/277; 60/285; 60/274

(58) Field of Search ..... 60/274, 276, 285, 60/277

(56) References Cited

U.S. PATENT DOCUMENTS

| | | | | |
|---|---|---|---|---|
| 5,228,286 | | 7/1993 | Demura . | |
| 5,293,740 | | 3/1994 | Heppner et al. . | |
| 5,438,826 | | 8/1995 | Blischke et al. . | |
| 5,473,888 | * | 12/1995 | Douta et al. | 60/276 |
| 5,609,023 | | 3/1997 | Katoh et al. . | |
| 5,727,383 | * | 3/1998 | Yamashita et al. | 60/277 |
| 5,737,916 | * | 4/1998 | Mitsutani | 60/276 |
| 5,755,094 | * | 5/1998 | Maki et al. | 60/276 |
| 5,758,490 | * | 6/1998 | Maki et al. | 60/277 |
| 5,806,012 | * | 9/1998 | Maki et al. | 60/274 |
| 6,021,767 | * | 2/2000 | Yasui et al. | 60/276 |
| 6,073,073 | * | 6/2000 | Kitamura et al. | 60/276 |

FOREIGN PATENT DOCUMENTS 4410489 10/1995 (DE) .

OTHER PUBLICATIONS

Japanese Abstract Pub. No. 07259602, Pub. Date Oct. 1995.
Japanese Abstract Pub. No. 10184426, Pub. Date Jul. 1998.
European Search Report Dated Dec. 1999.

* cited by examiner

*Primary Examiner*—Thomas Denion
*Assistant Examiner*—Diem Tran
(74) *Attorney, Agent, or Firm*—Liniak, Berenato, Longacre & White

(57) ABSTRACT

Method for controlling the strength of the air/fuel mixture supplied to an internal-combustion engine after the engine has been in a fuel cut-off operating condition during which a catalytic converter arranged along the exhaust pipe of the engine is acted on by a flow of air and stores oxygen; the method comprising the steps of measuring the strength of the mixture supplied to the engine by means of an oxygen sensor arranged along the exhaust pipe upstream of the catalytic converter; estimating the quantity of oxygen stored by the catalytic converter during the fuel cut-off condition on the basis of the measured strength; and, at the end of the fuel cut-off condition, correcting the strength of the mixture with respect to a target value in relation to the quantity of estimated oxygen, so as to ensure controlled enrichment of the mixture which allows rapid disposal of the oxygen stored by the catalytic converter; the correction of the strength allowing minimization of the time interval during which the catalytic converter operates at low efficiency at the end of the fuel cut-off condition.

13 Claims, 3 Drawing Sheets

λ1m
1
t

V2
V2th
t2
t

OXim
OXmax
OXth
t1
t

Δλox
t

Cut-off
Correction
T*
Fine cut-off
ABIL
t

METHOD FOR CONTROLLING THE STRENGTH OF THE AIR/FUEL MIXTURE SUPPLIED TO AN INTERNAL-COMBUSTION ENGINE

The present invention relates to a method for controlling the strength of the air/fuel. mixture supplied to an internal-combustion engine.

In particular, the present invention relates to a method for controlling the strength of the mixture after the engine has been in an operating condition known as the "cut-off" condition, during which the supply of fuel to the engine cylinders is interrupted.

During cut-off conditions, the catalytic converter which is arranged along the exhaust pipe of the engine is acted on by a flow of pure air and, acting in the manner of a lung, stores oxygen.

BACKGROUND OF THE INVENTION

As is known, the maximum efficiency of the catalytic converter, namely the capacity to eliminate successfully the polluting substances present in the combusted gases, depends both on the strength of the mixture supplied to the engine and on the existing state of the converter itself, namely on the quantity of oxygen which it has stored. In particular, the catalytic converter performs the catalytic action with the maximum efficiency if the strength of the mixture supplied to the engine is within a given range centered around the value of one and if the quantity of oxygen stored is any case less than a predefined threshold value.

During the cut-off condition, the catalytic converter, being acted on by the intake air of the engine, stores a quantity of oxygen which is far greater than the threshold value and therefore is made to operate in a low-efficiency zone.

At the end of the cut-off condition, despite the fact that a target strength close to the value of one is defined, the catalytic converter is unable to eliminate correctly the polluting substances on account of the excess oxygen stored.

Therefore, for the whole of the time required by the converter to dispose of this excess oxygen, the polluting emissions are not minimized.

At present, at the end of the cut-off condition, the target strength is corrected in a way which tends to enrich the mixture supplied to the engine in order to prevent the engine from stalling.

Enrichment of the mixture is performed independently of the state of the catalytic converter. This enrichment has a beneficial effect on the converter in that it allows it to dispose of part of the stored oxygen, but, being independent of the state of the converter itself (i.e. of the quantity of stored oxygen), it may sometimes be excessive to the detriment of the fuel consumption and the emission of polluting substances or, alternatively, it may be insufficient to the detriment of the time during which the converter is not operating at high efficiency.

SUMMARY OF THE INVENTION

The object of the present invention is that of providing a method for controlling the strength which, depending on the state of the catalytic converter (i.e. the quantity of stored oxygen), minimizes the time during which the catalytic converter is not operating at high efficiency at the end of the fuel cut-off condition.

According to the present invention a method for controlling the strength of the air/fuel mixture supplied to an internal-combustion engine of the type described in claim 1 is provided.

BRIEF DESCRIPTION OF THE DRAWINGS

The present invention will now be described with reference to the accompanying drawings which illustrate a non-limiting example of embodiment thereof, in which.

DETAILED DESCRIPTION OF THE INVENTION

Figure 1:
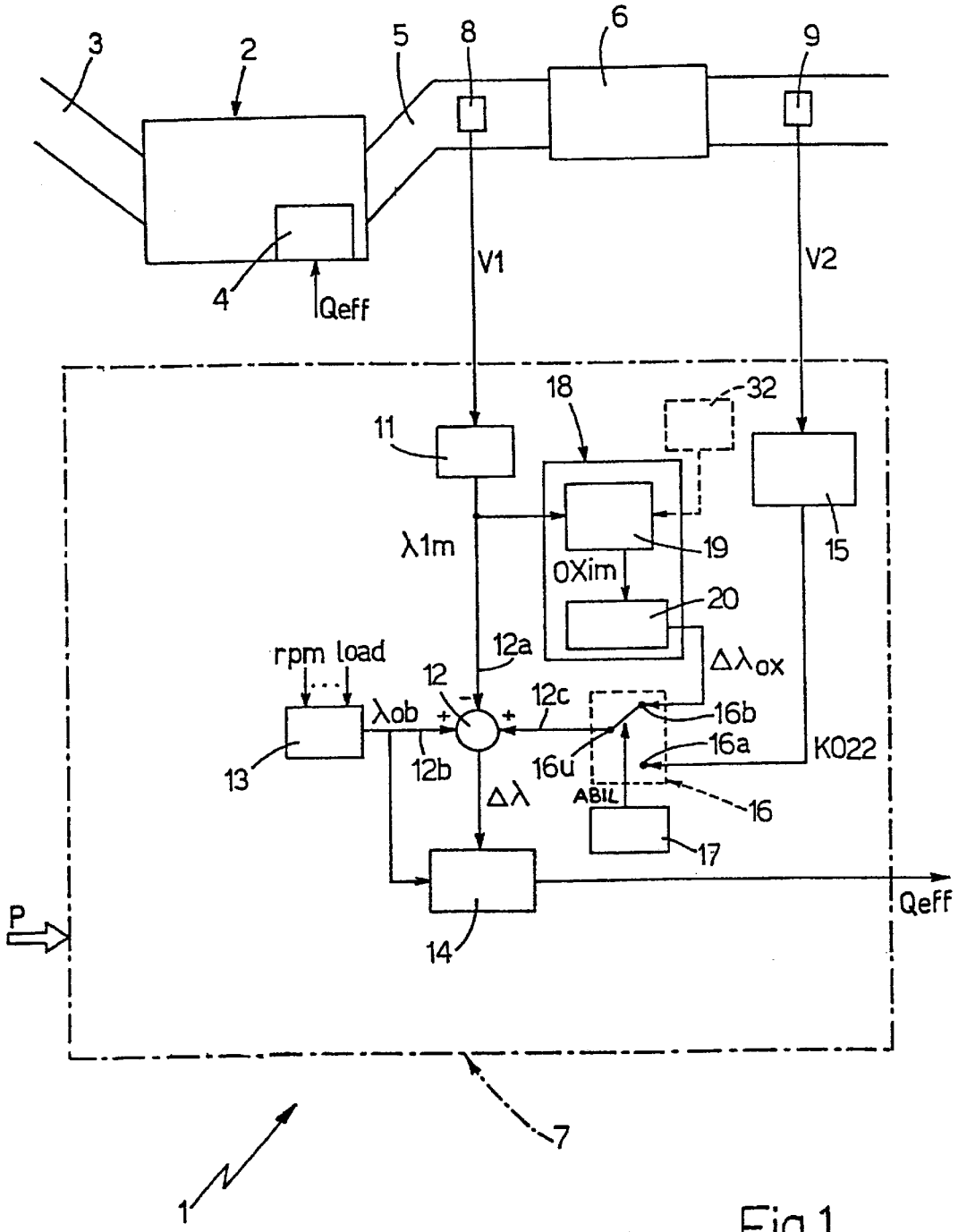
FIG. 1 shows schematically a device for controlling the strength of the mixture supplied to an internal-combustion engine provided in accordance with the principles of the present invention.

With reference to FIG. 1, 1 denotes in its entirety a device for controlling the strength of the air/fuel mixture supplied to an internal-combustion engine 2, in particular to a petrol engine. As is known, the strength of the mixture is defined by the air/fuel ratio A/F normalized to the stoichiometric air/fuel ratio (equal to 14.57).

The engine 2 has an intake manifold 3 for supplying a flow of air to the cylinders (not shown) of the engine, a system 4 for injecting the petrol into the actual cylinders, and an exhaust pipe 5 for conveying away from the engine the combusted gases.

The exhaust pipe 5 has, arranged along it, a catalytic converter 6 (of the known type and for example comprising a pre-catalytic conversion unit) for eliminating the polluting substances present in the exhaust gases.

The control device 1 comprises a central control unit 7 (shown schematically in FIG. 1) which is responsible for managing operation of the engine. The central control unit 7 receives at its input a plurality of data signals P measured in the engine 2 (for example number of rpm, air flow rate, intake air, etc.) together with signals P relating to data outside the engine (for example, position of the accelerator pedal, etc.) and is able to operate the injection system 4 so as to regulate the quantity of petrol to be supplied to the cylinders.

The device 1 co-operates with two oxygen sensors 8 and 9 of the known type, which are arranged along the pipe 5 respectively upstream and downstream of the catalytic converter 6 and are able to provide information relating to the stoichiometric composition of the exhaust gases upstream and downstream of the catalytic converter 6 itself. In particular the sensor 8 (consisting, for example, of an UEGO probe) is able to output a reaction signal V1 indicating the composition of the exhaust gases upstream of the catalytic converter 6 and therefore correlated to the strength of the mixture supplied to the engine. The sensor 9 (consisting, for example, of a LAMBDA probe) is able to output a signal V2 indicating the stoichiometric composition of the gases introduced into the external environment and therefore correlated to the strength of the exhaust emission.

The signal V1 is supplied to a conversion circuit 11 of the known type, which is able to able to convert the signal V1 itself into a digital parameter λlm representing the strength of the mixture supplied to the engine 2 and defined as:

$$\lambda lm = \frac{(A/F)meas}{(A/F)stoich}$$

where (A/F)meas represents the value of the air/fuel ratio measured by the sensor 8 and correlated to the signal V1 and (A/F)stoich represents the value of the stoichiometric air/fuel ratio equal to 14.57. In particular, if the value of the parameter λlm is greater than one (λlm >1) the mixture supplied to engine 2 is said to be lean, whereas if the value of the parameter λlm is less than one (λlm <1) the mixture supplied to the engine 2 is said to be rich.

The digital parameter λlm is supplied to a substracter input 12*a* of an adder node 12 having, in addition, an adder input 12*b* which is supplied with the digital value of a parameter λob representing a target strength and defined as:

$$\lambda ob = \frac{(A/F)targ}{(A/F)stoich}$$

where (A/F)targ represents the value of the air/fuel target ratio which it is desired to achieve and (A/F)stoich is the value of the stoichiometric air/fuel ratio (equal to 14.57).

The parameter λob is output (in a known manner) from an electronic table 13 to which at least some of the data signals P (for example, those relating to the number of rpm, the load applied to the engine 2, etc.) are input.

The node 12 therefore outputs an error parameter Δλ indicating the divergence between the target parameter λob and the parameter λlm, namely $$\Delta\lambda = \lambda ob - \lambda lm$$

The error parameter Δλ is then supplied to a processing circuit 14 (of the known type) which, on the basis of the target strength λob and the value of the error parameter Δλ, determines the quantity of effective fuel Qeff which the injection system 4 must inject into the cylinders during the engine cycles.

A feedback loop, or feedback control system, is thus provided for the mixture strength, which is aimed at reducing to zero the error parameter Δλ so that the measured strength (λlm) follows the progression of the target strength (λob).

In accordance with that shown in FIG. 1, the signal V2 output by the sensor 9 is supplied to a processing circuit 15 of the known type, which is able to process it so as to produce a correction parameter KO22 which is supplied to an input 16*a* of a selector 16. The selector has a second input 16*b* and an output 16*u* connected to a further adder input 12*c* of the node 12. The selector 16 is able to connect selectively and alternately the inputs 16*a* and 16*b* to the output 16*u* itself depending on the value of a binary signal ABIL output from a control block 17, the function of which will become apparent below. In particular, when the signal ABIL assumes the high logic level, the parameter KO22 output by the circuit 15 is supplied to the node 12 in order to correct the error parameter Δλ in accordance with the expression Δλ=λob−λlm+KO22.

In this way, when the signal ABIL assumes the high logic level, an additional control loop (defined by the sensor 9 and the circuit 15) is closed, said loop being able to improve the feedback control provided by the loop comprising the sensor 8. As is known, this additional control loop (currently present in the commercially available control devices) allows compensation of any drift phenomena introduced by the control loop comprising the sensor 8, taking into consideration the composition of the exhaust gases emitted into the atmosphere, namely the effective strength upon discharge, which is defined by the parameter:

$$\lambda 2m = \frac{(A/F)targ}{(A/F)stoich}$$

where (A/F)meas represents the value of the air/fuel ratio measured by the sensor 9 and correlated to the signal V2.

The catalytic converter 6 has the capacity to store oxygen and performs the catalytic action by exchanging oxygen with the incoming exhaust gases, namely by reducing and oxygenating. The efficiency of the catalytic converter 6, namely its capacity to eliminate the pollutants, is dependent both on the strength λlm of the mixture and on the state of the catalytic converter 6 itself, namely on the quantity of stored oxygen OXim. In particular, the maximum efficiency is achieved when the strength λlm is within a given range centred around the value of one (stoichiometric strength) and, at the same time, the quantity of stored oxygen OXim is less than a given threshold value OXth.

When the engine 2 is operating in the condition known as the fuel cut-off condition, for example following raising of the accelerator pedal, the central control unit 7 causes interruption of the fuel supply to the cylinders (Qeff=0), disabling in a known manner the two abovementioned control loops. Consequently, the catalytic converter 6 is acted on by a flow of pure air and starts to store oxygen. The quantity of oxygen accumulated becomes greater than the threshold value $OX_{th}$ and, therefore, the catalytic converter 6 is operating in a low efficiency zone in terms of elimination of the polluting substances.

At the end of the cut-off condition, the central control unit 7 re-enables in a known manner the control loop comprising the sensor 8 and, despite the fact that an approximately stoichiometric target strength λob is defined (and the strength λlm measured by the sensor 8 soon falls below the stoichiometric value), the catalytic converter 6 is not immediately able to operate at maximum efficiency since it has stored excess oxygen.

According to the present invention, the control device 1 comprises a further block 18 for correction of the target strength λob, able to achieve optimization of the performance of the catalytic converter 6 (and therefore minimization of the polluting emissions) when the engine 2 is no longer in the cut-off operating condition. The correction block 18 has the function of accelerating the restoration of the maximum efficiency of the catalytic converter 6 at the end of the cut-off condition and, for this purpose, is able to output a parameter Δλox for correction of the target strength λob so as to cause enrichment of the mixture depending on the state of the catalytic converter 6 itself and thus allow rapid disposal of the excess oxygen stored. In particular (see FIG. 1), the correction parameter Δλox is supplied to the input 16*b* of the selector 16 and is able to correct the error parameter Δλ (in accordance with the expression Δλ=λob−λlm+Δλox) when the signal ABIL, output from the block 17, assumes a low logic level.

According to the invention, the control block 17 is able to manage correction of the target strength λob (by means of enabling or disabling of the block 18 and the control loop comprising the sensor 9) during the time period following the end of the cut-off condition of the engine. In particular, the block 17 produces a low logic value of the signal ABIL as soon as the engine is no longer in the cut-off condition, so as to allow the block 18 to correct the target strength λob and keep the control loop comprising the sensor 9 disabled. When the catalytic converter 6 has disposed of the excess oxygen stored and returns into the high-efficiency operating state, the block 17 outputs the low logic level of the signal ABIL, enabling the control loop comprising the sensor 9.

The correction block 18 comprises an estimator block 19 able to estimate the quantity of oxygen OXim stored by the catalytic converter 6 during the cut-off condition and at the end of the condition itself, and a processing block 20 able to output the parameter Δλox for correction of the target strength λob in relation to the quantity of oxygen OXim estimated by the block 19.

Figure 2:
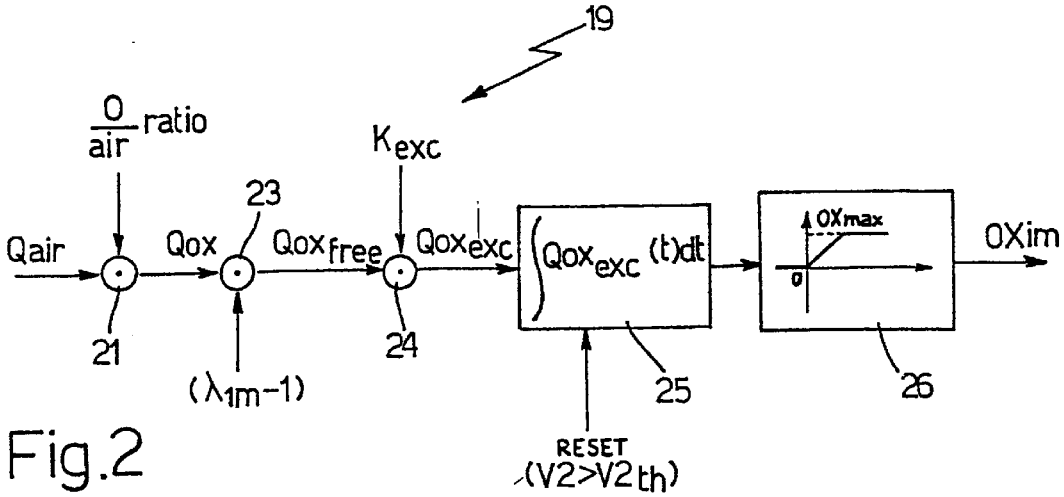
FIG. 2 shows schematically a functional block forming part of the device according to FIG. 1 and able to estimate the quantity of oxygen stored in the catalytic converter.

FIG. 2 shows the estimator block 19 which defines a model for estimating the quantity of oxygen OXim stored in the catalytic converter 6. The block 19 receives at its input the flow rate of intake air Qair and has a multiplier 21 able to multiply it by the ratio O/Air defining the percentage of oxygen in the air, so as to output the flow rate of intake oxygen Qox. The flow rate Qox therefore represents the oxygen flow rate which would be supplied to the catalytic converter 6 if no combustion cycles were to occur inside the cylinders.

The flow rate Qox is then multiplied in a multiplier 23 by a term defined by the difference between the strength λlm measured by means of the sensor 8 and the stoichiometric strength (value of one) so as to produce the flow rate $QOX_{free}$ of free oxygen in the exhaust gases entering the catalytic converter 6. The flow rate $Qox_{free}$ is then calculated in accordance with the expression:

$$QOX_{free}=Qox(\lambda lm-1).$$

When there is a stoichiometric strength λlm (λlm=1) the flow rate $Qox_{free}$ is zero since there is no free oxygen in the exhaust gases; when there is a strength λlm which is lean (λlm>1) the flow rate Qoxfree assumes a positive value, indicating the availability of free oxygen in the exhaust gates entering the catalytic converter 6 and therefore the possibility of oxygen storage by the catalytic converter 6 itself; when there is a strength λlm which is rich (λlm<1) the flow rate $Qox_{free}$ assumes a negative value, indicating a lack of free oxygen in these gases and therefore the need for the catalytic converter 6 to compensate for this shortage by drawing upon the stored oxygen.

Only a part of the free oxygen present in the exhaust gases may be stored by the catalytic converter 6 and, in the same way, only a part of the oxygen required from the catalytic converter 6 may be extracted in order to compensate for the abovementioned shortage. Consequently the flow rate $Qox_{free}$ is multiplied by an exchange factor $K_{exc}$ in a multiplier 24 so as to produce the oxygen flow rate $Qox_{exc}$ which may be exchanged between the catalytic converter 6 and the exhaust gases ($QOx_{exc}=K_{exc}\ QoX_{free}$). The exchange factor $K_{exc}$ is a constant which assumes a first given value if the strength λlm is lean (λlm>1), whereas it assumes a second given value if the strength λlm is rich (λlm<1)

The flow rate $Qox_{exc}$ of oxygen which may be exchanged between exhaust gases and catalytic converter 6 is then integrated over time inside a block 25 so as to offer the quantity of oxygen OXim stored during the integration time interval. This integration is performed as soon as the engine enters the cut-off condition, assuming that the initial quantity of oxygen contained in the catalytic converter 6 is equal to a calibration value approximately equivalent to the said threshold value $OX_{th}$. By so doing, the block 25 supplies at its output the time evolution of the quantity OXim of oxygen stored in the catalytic converter 6.

The quantity OXim of stored oxygen obtained by means of integration may not be less than a zero minimum limit (catalytic converter empty) and may not exceed a maximum limit OXmax defining the storage capacity OXmax of the catalytic converter 6; in order to express this, a saturation block 26 able to limit the quantity OXim of stored oxygen to the storage capacity OXmax has been incorporated in the model.

Figure 3:
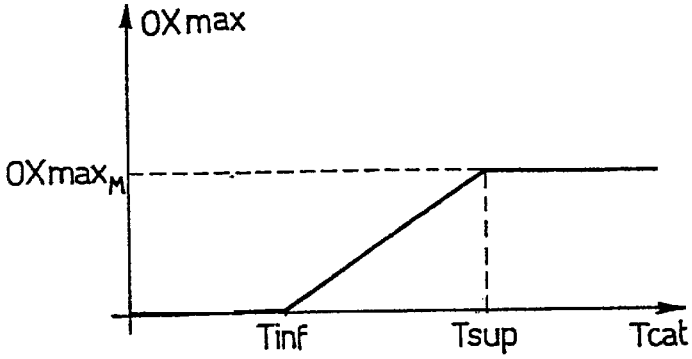
FIG. 3 shows the progression of the maximum capacity for oxygen storage of the catalytic converter as a function of the temperature of the converter itself.

In accordance with that shown in FIG. 3, the model (defined by the block 19) takes into consideration the fact that the storage capacity OXmax of the catalytic converter 6 is dependent upon the temperature Tcat of the catalytic converter itself. The dependency of the capacity OXmax on the temperature Tcat was modelled by means of the progression illustrated in FIG. 3. In particular, if the temperature Tcat is less than a threshold value Tinf (of about 300° C.), the catalytic converter 6 is unable to exchange oxygen with the exhaust gases (Oxmax=0); if the temperature Tcat is higher than a threshold value Tsup (of about 400° C.), the capacity OXmax reaches the physical limit OXmaxM, which represents the maximum storage capacity of the catalytic converter; if, finally, the temperature Tcat is within the range (Tinf–Tsup), the capacity OXmax varies linearly with the temperature Tcat itself.

Figure 4:
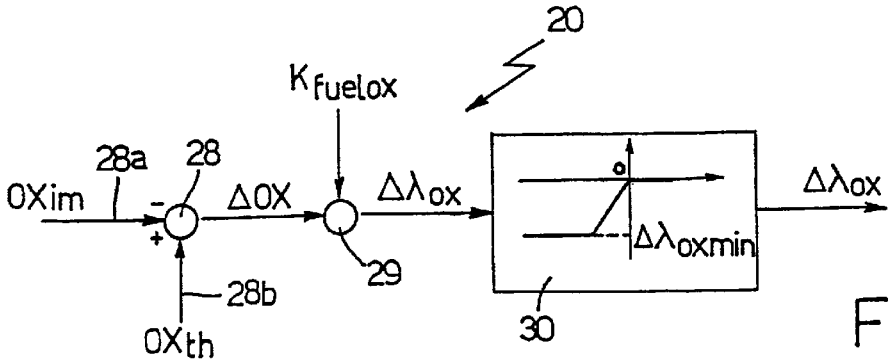
FIG. 4 shows schematically a further functional block forming part of the device according to FIG. 1.

With reference to FIG. 4, the block 20 will now be described; said block, as mentioned, calculates the correction parameter $\Delta\lambda_{ox}$ to be applied to the target strength λob (FIG. 1) as soon as the engine is no longer in the cut-off condition, so as to enrich the mixture and allow restoration of the high-efficiency conditions of the catalytic converter 6.

In the block 20 the quantity OXim of stored oxygen (output from the block 19) is supplied to a subtracter input 28*a* of an adder node 28 having an adder input 28*b* which is supplied with the threshold value $OX_{th}$ indicating the quantity of oxygen beyond which the catalytic converter 6 operates at low efficiency. The node 28 outputs an error parameter ΔOX defined by the divergence between the quantity OXim and the threshold value $OX_{th}$ ($\Delta OX=OX_{th}-OXim$). The error parameter AOX is supplied to a multiplier 29 where it is multiplied by a control parameter $K_{fuelox}$ (which can be set) so as to produce the parameter $\Delta\lambda_{ox}$ defining the correction to be made to target strength λob.

The parameter $\Delta\lambda_{ox}$ which defines the negative correction to be made to the strength λob is then supplied to a saturation block 30 where its lower limit is defined at a threshold value $\Delta\lambda_{oxmin}$ so as to avoid producing an exaggerated correction. The output of the block 30 thus represents the correction parameter $\Delta\lambda_{ox}$ to be supplied to the input 16*b* of the selector 16 (FIG. 1). In this way, the correction of the target strength λob is proportional to the quantity of oxygen OXim stored in the catalytic converter 6.

FIGS. 5 to 9 show in graphic form the time progressions of the strength λlm measured upstream of the catalytic converter 6 (FIG. 5), the signal V2 output from the sensor 9 (FIG. 6), the quantity OXim of stored oxygen (FIG. 7), the correction parameter $\Delta\lambda_{ox}$ output from the block 20 and the signal ABIL output from the block 17. These progressions illustrate the performance of the control device 1 when the engine is in the cut-off condition and at the end of this condition. In particular, as soon as the engine enters the cut-off condition, the strength λlm increases enormously and the quantity Oxim of oxygen stored in the catalytic converter 6 (estimated by the block 19) starts to increase with respect to the initial value $OX_{th}$ until it reaches, for example, the storage capacity OXmax.

At the same time, the signal V2 output by the sensor 9 falls to a value of approximately zero, indicating that the gases introduced into the external environment are rich in oxygen.

When the engine is in the cut-off condition, both the feedback control loops are disabled and the signals V1 and V2 output by the sensors 8 and 9 continue to be measured.

At the end of the cut-off condition, the control loop comprising the sensor 8 is enabled and, in this way, a target strength λob is defined for the mixture supplied to the engine. It should be noted that generally, at the end of the cut-off condition, the target strength λob produced by the electronic table 13 is approximately stoichiometric.

At the end of the cut-off condition, the signal ABIL assumes the low logic level, allowing the block 19 to start to apply the correction parameter $\Delta\lambda_{ox}$ to the target strength λob.(FIG. 8); consequently, the mixture supplied to the engine is enriched and the strength λlm becomes rich. As a result, it is possible to start to dispose of the quantity OXim of stored oxygen, which in fact decreases (FIG. 7).

Figures 5, 6, 7, 8, 9:
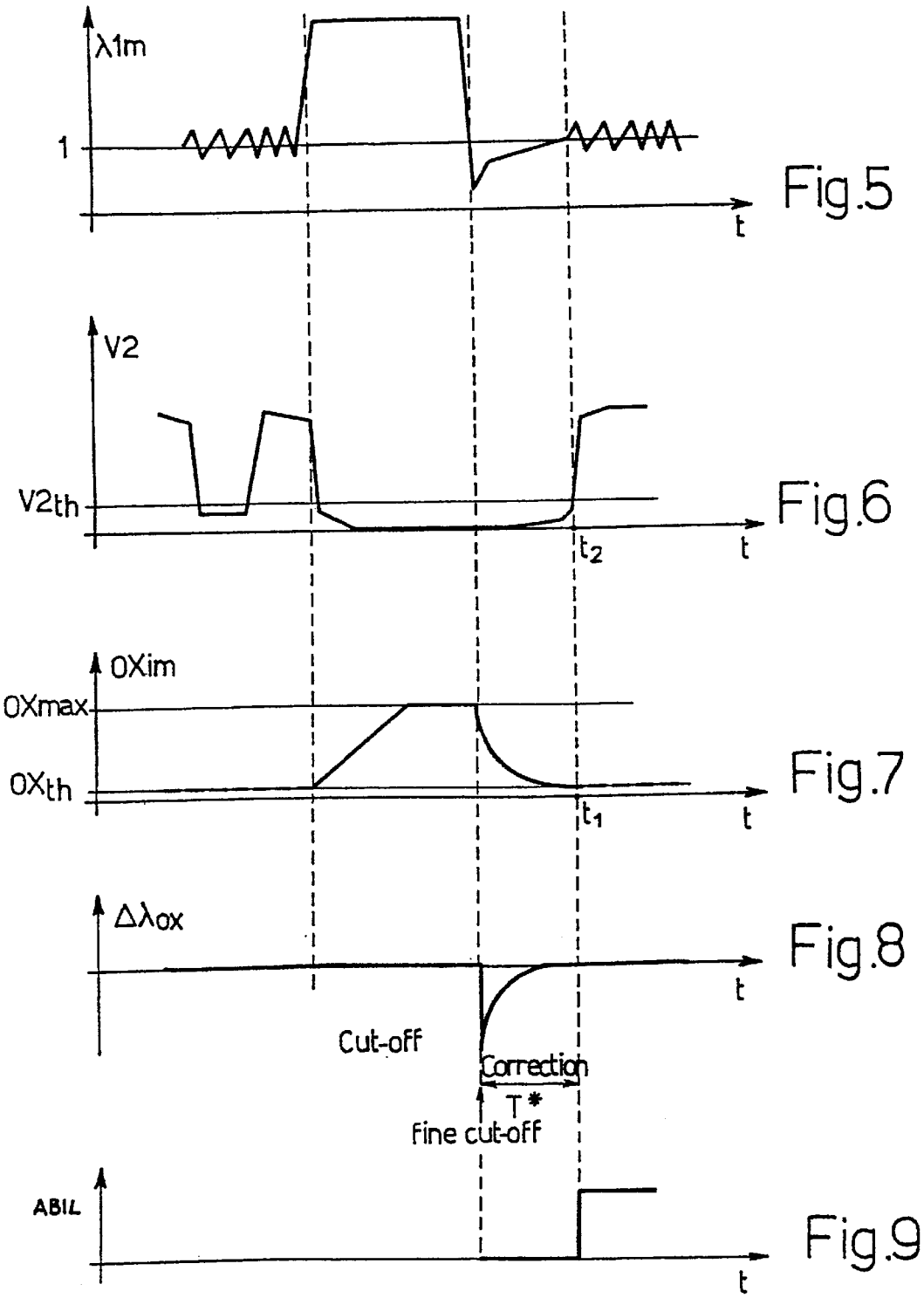
FIGS. 5 to 9 show the temporal progression of certain parameters which are particularly significant according to the method of the present invention.

The relation of proportionality between the correction parameter $\Delta\lambda_{ox}$ and the quantity of excess oxygen stored in the catalytic converter ensures that the correction of the target strength λob is completed within a finite time interval T* (FIG. 8). In particular, by setting the parameter $K_{fuelox}$ (FIG. 4) it is possible to modulate the amplitude of the time interval T* obtaining, for example, a pulse-type progression of the correction parameter $\Delta\lambda_{ox}$ (see FIG. 8). The parameter $K_{fuelox}$ is generally set so as to obtain the best possible compromise between the amplitude of the time interval T* and the maximum possible correction of the strength λob.

When the quantity OXim of oxygen becomes equal again to the threshold value OXth (i.e. ΔOX=0), indicating that the maximum efficiency of the catalytic converter has been restored, the signal ABIL (FIG. 9) switches and the control loop comprising the downstream sensor 9 is re-enabled.

From the above description it can be understood that the control device 1 (and in particular the block 18), at the end of the cut-off condition, allows restoration of the maximum efficiency of the catalytic converter, thereby minimizing the emissions of pollutants.

According to the present invention, moreover, the control device 1 is provided with a functional block 32 (indicated by broken lines in FIG. 1) able to provide an adaptability function for the model (block 19) which estimates the quantity OXim of stored oxygen. This adaptability function has the aim of compensating for the approximations performed by the model itself and, in particular, ageing of the catalytic converter 6, which, as is known, results in a reduction in the storage capacity of the catalytic converter itself.

In the example illustrated, the parameter which is adapted by the block 32 is the maximum storage capacity of the catalytic converter $OXmax_M$ (FIG. 3), which is of particular interest, since it allows a diagnosis to be carried out with regard to the state of wear of the catalytic converter 6. The adaptability function is applied following those cut-off conditions where the maximum storage capacity of the catalytic converter 6 has been saturated, i.e. the quantity OXim has reached the maximum capacity $OXmax_M$.

The adaptability function is based on the estimated error of the model (block 19), which is related to the time which passes between an instant $t_1$ (FIG. 7), when the model indicates that the excess oxygen in the catalytic converter 6 has been completely disposed of (i.e. ΔOX=0), and an instant $t_2$ FIG. 6), when the signal V2 output by the sensor 9 assumes a given threshold value $V2_{th}$ (which can be set), indicating a strength of the exhaust emission which is no longer lean. In the example shown in FIG. 6, the threshold value $V2_{th}$ is a value where the progression of the signal V2 changes inclination, indicating imminent switching of the downstream sensor 9 (LAMBDA probe).

If the instant $t_1$ precedes the instant $t_2$ (namely the excess oxygen is disposed of completely before the signal V2 assumes the value $V2_{th}$), this means that the maximum storage capacity $Oxmax_M$ has been underestimated and, consequently, the maximum capacity $OXmax_M$ itself is adapted by increasing it by a given amount (for example, in relation to the estimated error). If, on the other hand, the instant $t_1$ follows the instant $t_2$ (namely the signal V2 assumes the value $V2_{th}$ before the excess oxygen is completely disposed of), this means that the maximum storage capacity $OXmax_M$ has been overestimated and, consequently, it is decreased by a given amount (for example, in relation to the estimated error). The adapted value of the maximum storage capacity $OXmax_M$ will then be used in the estimator block 19 when the engine 2 enters the cut-off condition again.

In the case where the signal V2 assumes the value $V2_{th}$ before the excess oxygen has been used up, the block 32, moreover, is able to carry out a reset operation on the block 25 (see FIG. 2) in order to reduce to zero the error parameter ΔOX (FIG. 4) and prevent the correction $\Delta\lambda_{ox}$ of the strength λob, and hence enrichment of the mixture, from being needlessly maintained.

Finally it should be pointed out that the block 32, by means of adaptability of the maximum capacity OXim, allows a diagnosis to be performed as to the state of wear of the catalytic converter 6. In fact, if the maximum capacity OXim which is adapted continues to assume values less than a given threshold during a certain number of successive cut-off conditions, the catalytic converter 6 may be regarded as worn and the block 32 may signal the lack of efficiency thereof.

What is claimed is:

1. Method for controlling the strength of the air/fuel mixture supplied to an internal-combustion engine after the engine has been in a fuel cut-off operating condition during which a catalytic converter arranged along the exhaust pipe of the engine is acted on by a flow of air and stores oxygen; the method being comprising the steps of:

measuring the strength of the mixture supplied to the engine by means of a first oxygen sensor arranged along the exhaust pipe upstream of the catalytic converter;

estimating the quantity of oxygen stored by the catalytic converter on the basis of the strength (Mm) measured upstream of the catalytic converter itself; and executing, at the end of the fuel cut-off condition, a first correction of the target strength of the mixture to be supplied to the engine, with respect to an approximately stoichiometric value, in relation to the estimated quantity of oxygen stored so as to ensure controlled enrichment of the mixture aimed at allowing rapid disposal of the oxygen stored by the catalytic converter; said step of executing said first correction of the target strength being achieved by applying a correction parameter to the target strength when the engine is no longer in the fuel cutoff condition; and correction being maintained until the quantity of oxygen stored in the catalytic converter is greater than a given threshold value;

executing a second correction of the target strength by processing an output signal of a second oxygen sensor arranged along the exhaust pipe downstream of the catalytic converter;

disabling said second correction during said step of executing said first correction;

enabling said second correction when the quantity of oxygen stored in the catalytic converter is equal to the said given threshold value, indicating that disposal of the oxygen stored by the catalytic converter during the fuel cut-off condition has occurred.

2. Method according to claim 1, further comprising the steps of:

comparing the strength measured by means of the first sensor with the target strength so as to define an error parameter representing the divergence between the said target strength and the measured strength;

processing the error parameter and the target strength so as to determine the quantity of effective fuel to be supplied to the engine.

3. Method according to claim 1, characterized in that the step according to para. b) is performed by a model (19) for estimating the quantity of oxygen (Oxim) stored, and comprises the substeps of:

b1) calculating (21) the flow rate (Qox) of intake oxygen into the engine on the basis of the flow rate of the intake air (Qair);

b2) calculating (23) the flow rate ($Qox_{free}$) of free oxygen in the exhaust gases entering the catalytic converter (6) on the basis of the flow rate (Qox) of intake oxygen and the divergence between the measured strength (λlm) and the stoichiometric strength;

b3) calculating (24) the flow rate ($Qox_{exc}$) of oxygen which may be exchanged between the catalytic converter (6) and the exhaust gases by multiplying the flow rate ($Qox_{free}$) by a given exchange factor ($K_{exc}$); and b4) integrating (25) over time the said flow rate ($QOX_{exc}$) of oxygen which may be exchanged between the catalytic converter (6) and the exhaust gases, so as to obtain the time evolution of the said quantity of oxygen (OXim) stored by the catalytic converter (6).

4. Method according to claim 3, characterized in that the said estimating step according to para. b) comprises, moreover, the substep of:

b5) limiting (26) the quantity of stored oxygen (OXim), obtained by means of the said integration, to an upper limit value defining the oxygen storage capacity (OXmax) of the catalytic converter (6).

5. Method according to claim 4, characterized in that the said upper limit value defining the oxygen storage capacity (OXmax) of the catalytic converter (6) is dependent upon the temperature (Tcat) of the catalytic converter (6) itself; the method comprising the step of modelling the dependency of the storage capacity (OXmax) on the temperature (Tcat) by means of a function comprising:

a constant section with a zero value if the temperature is less than a lower threshold value (Tinf);

a constant section with a value defining the maximum storage capacity ($OXmax_M$) of the converter (6), if the temperature (Tcat) is greater than an upper threshold value (Tsup); and a linear joining section if the temperature (Tcat) is between the said upper and lower threshold limits (Tinf, Tsup).

6. Method according to claim 2, characterized in that the said correction step according to para. c) comprises the substeps of:

c1) comparing (28) the quantity of oxygen (OXim) at present stored in the catalytic converter (6) with the said given threshold value ($OX_{th}$), so as to produce a divergency parameter (ΔOX);

c2) multiplying (29) the divergency parameter (ΔOX) by a control parameter ($K_{fuelox}$) which can be set so as to produce the said correction parameter ($\Delta\lambda_{ox}$) for the said target strength (λob).

7. Method according to claim 6, characterized in that the said correction step according to para. c) comprises the further substep of:

c3) saturating (30) the said correction parameter ($\Delta\lambda_{ox}$) to a limit value ($\Delta\lambda_{oxmin}$) before applying the said correction to the target strength (λob).

8. Method according to claim 3, characterized in that it comprises, moreover, the step of providing (32) an adaptability function for the said model (19) for estimating the quantity of oxygen (OXim) stored in the catalytic converter (6); the said adaptability function adapting the model (19) so as to compensate for ageing of the catalytic converter (6) and the approximations performed in the model (19) itself.

9. Method according to claim 5, characterized by the fact of applying the said adaptability function for the said model (19) following the fuel cut-off conditions during which the quantity of oxygen (OXim) has saturated the said maximum storage capacity ($OXmax_M$) of the catalytic converter (6).

10. Method according to claim 9, characterized in that the said adaptability function adapts the said maximum oxygen storage capacity ($OXmax_M$) of the catalytic converter (6) in relation to an estimated error of the model (19), the estimated error being related to the time which passes between a first instant ($t_1$), when the quantity of estimated oxygen (OXim) assumes the said given threshold value ($OX_{th}$), and a second instant ($t_2$), when the said signal output by the second sensor (9) assumes a given value ($V2_{th}$) indicating the presence of a composition of gases introduced into the atmosphere which is nearly stoichiometric.

11. Method according to claim 10, characterized in that the said adaptability function increases the said maximum storage capacity ($OXmax_M$) of the catalytic converter (6) if the said first instant ($t_1$) precedes the said second instant ($t_2$); the said adaptability function decreasing the maximum storage capacity ($OXmax_M$) of the catalytic converter (6) if the said first instant ($t_1$) follows the said second instant ($t_2$).

12. Method according to claim 10, characterized in that it comprises the step of carrying out a diagnosis (32) as to the state of wear of the catalytic converter (6) on the basis of the maximum storage capacity value ($OXmax_M$) offered by the said adaptability function.

13. Method according to claim 12, characterized in that the catalytic converter (6) is considered to be worn if the maximum storage capacity ($OXmax_M$) offered by the adaptability function is reconfirmed as being lower than a given minimum value at the end of a plurality of successive fuel cut-off conditions.

* * * * *